United States Patent [19]

Cines et al.

[11] 4,132,764

[45] Jan. 2, 1979

[54] PRODUCTION OF CARBON MONOXIDE FROM CARBONACEOUS MATERIAL AND ZINC OXIDE

[75] Inventors: Martin R. Cines; Forrest L. Poska, both of Bartlesville, Okla.

[73] Assignee: Phillips Petroleum Company, Bartlesville, Okla.

[21] Appl. No.: 716,401

[22] Filed: Aug. 23, 1976

[51] Int. Cl.[2] ..... C01B 31/18

[52] U.S. Cl. ..... 423/415 A; 423/622; 423/623; 75/86; 75/88; 48/197 R

[58] Field of Search ..... 423/415 A, 622, 623, 423/107; 75/86–88; 48/196 R, 197 R; 165/107, DIG. 12

[56] References Cited

U.S. PATENT DOCUMENTS

| | | | |
|---|---|---|---|
| 799,743 | 9/1905 | Mackay | 75/88 |
| 1,355,904 | 10/1920 | McKee | 423/623 |
| 1,899,184 | 2/1933 | de Simo | 48/196 R |
| 2,041,237 | 5/1936 | Feuer et al. | 423/623 |
| 2,333,845 | 11/1943 | Danforth | 165/107 X |
| 2,342,368 | 2/1944 | Queneau | 75/86 |
| 2,602,809 | 7/1952 | Dickinson | 423/415 A |
| 2,779,803 | 1/1957 | Bottenberg | 23/260 X |
| 2,844,453 | 7/1958 | Kapp et al. | 423/415 A |

*Primary Examiner*—Earl C. Thomas

[57] ABSTRACT

A carbon source and zinc oxide are reacted in a reactor to form a gas consisting essentially of carbon monoxide and zinc; the zinc is separated from the gas and reoxidized in indirect heat exchange relationship with the reaction mixture of the carbon source and the zinc oxide. A portion of the carbon monoxide and zinc-comprising gas formed can be recycled to the reactor as a fluidizing gas.

11 Claims, 1 Drawing Figure

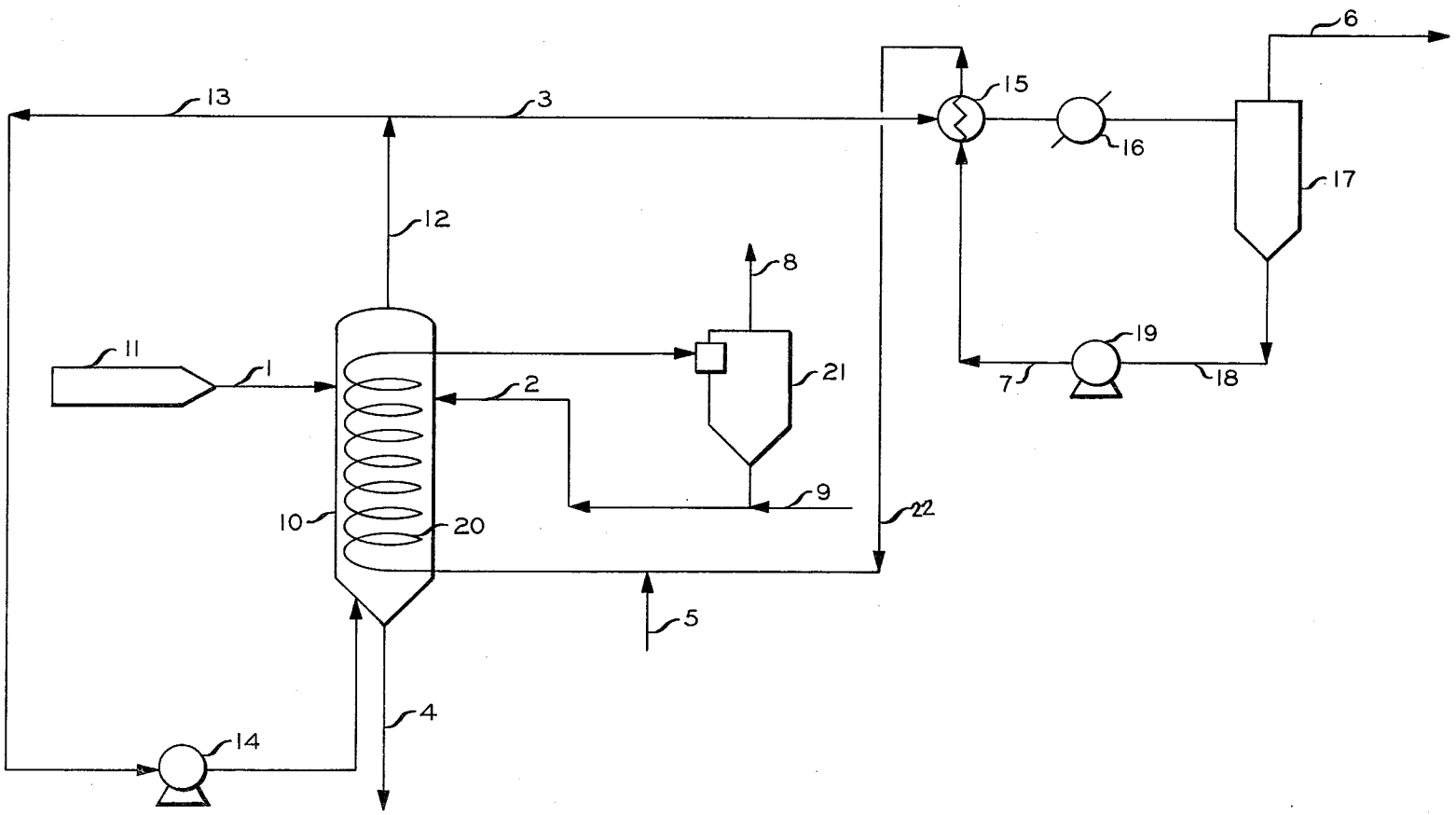
6
17
18
16
19
15
7
22
21
9
8
5
3
2
20
12
4
10
1
13
14
11

PRODUCTION OF CARBON MONOXIDE FROM CARBONACEOUS MATERIAL AND ZINC OXIDE

This invention relates to the production of carbon monoxide. More specifically this invention relates to the gasification of solid or heavy liquid carbon sources. A further aspect of this invention is the gasification of carbon sources in the absence of air.

BACKGROUND OF THE INVENTION

The conversion of solid carbon sources to a gas was developed many years ago. One process known as coal gasification contacts coal and steam under elevated temperature conditions to produce a gas consisting essentially of carbon monoxide and hydrogen, also called synthesis gas. The coal gasification processes are of great interest since they generally have the advantages of providing the potential of an environmentally clean process for coal utilization, of producing a high heating value gas which can substitute for natural gas or of producing a lower heating value gas suitable for use as synthesis gas for subsequent conversion to hydrocarbons or chemicals or as boiler fuel.

The introduction of air in a coal gasification process is generally undesirable since large volumes of nitrogen have to be handled in the process. It would, therefore, be desirable to have a process available which uses a different oxygen source than air for the conversion of the carbon source into carbon monoxide. In addition, in case the carbon monoxide forming reaction is an endothermic reaction, it would be desirable to have means available by which the heat necessary for this carbon monoxide forming reaction can be at least partially furnished from another process step such as to reduce the heat consumption in the process to a minimum.

The Invention

It is, therefore, one object of this invention to provide a process for the production of carbon monoxide.

Another object of this invention is to provide a process for the production of carbon monoxide from carbon sources essentially in the absence of air.

A further object of this invention is to provide a process for the production of carbon monoxide from solid carbon sources and solid oxygen donor materials in which the reduced oxygen donor can be readily reoxidized and recycled.

Yet a further object of this invention is to produce a mixture of carbon monoxide and hydrogen.

These and other objects, advantages, details, features and embodiments of this invention will become apparent to those skilled in the art from the following detailed description of the invention, the appended claims and the drawing which shows a schematic flow diagram for the process of this invention.

In accordance with this invention, there is now provided a process for the production of carbon monoxide in which a carbon source and zinc oxide are reacted in a main reaction to form a gaseous effluent of carbon monoxide and zinc, in which the gaseous effluent is separated into a stream of zinc and a stream of gas consisting essentially of carbon monoxide, and in which the zinc is reoxidized to form zinc oxide in indirect heat exchange relationship with the mixture of the carbon source and the zinc oxide of the main reaction. In addition to the absence of air in the main reaction, a further advantage of this invention resides in the efficient utilization of the heat developed by the zinc oxidation in order to provide the heat consumed in the endothermic main reaction.

Further, preferred features of the process of this first embodiment of the invention are described in the following.

The zinc is removed from the gas comprising carbon monoxide and zinc by condensing it, removing the liquid zinc and recovering a gas consisting essentially of carbon monoxide. Preferably the condensation of Zn vapors is carried out by cooling the gas to about 500° C. or below. The zinc is then reoxidized. This can be done with any oxygen donor. It is, however, presently preferred to use air or water as the oxygen donor for this step. The reoxidized zinc is reintroduced into the reactor as solid zinc oxide.

The reoxidation of the zinc is preferably carried out by premixing a stream of zinc and oxygen donor and passing this mixture through indirect heat exchange means that are in contact with the main reaction mixture of the carbon source and the zinc oxide so that the heat developed in the reoxidation step converting zinc to zinc oxide is utilized to maintain the reaction temperature in the endothermic reaction between the zinc oxide and the carbon source. Depending upon the particular design of the apparatus used, the oxidation reaction converting zinc to zinc oxide occurs within the heat exchange means mentioned and/or just upstream thereof. The design of the apparatus will be such that the desired quantity of heat is transferred to the reaction mixture in the main reactor in which the zinc oxide and the carbon source are reacted to form carbon monoxide under elevated temperature conditions.

For the production of a gas similar to synthesis gas ($CO + H_2$), it is particularly desirable to carry out the zinc oxidation step utilizing steam as the oxygen donor. Thereby hydrogen is produced which is mixed with the carbon monoxide produced to result in a gas similar to synthesis gas and consisting essentially of carbon monoxide and hydrogen. This gas mixture then can be further utilized for the production of hydrocarbons or other chemicals.

The carbon source in the main reaction can be any carbon-containing material that will react with zinc oxide under elevated temperature conditions to form carbon monoxide and zinc. Preferably, however, the carbon source is a solid carbon source or a heavy liquid carbon source. Examples for such a carbon source are coal, coke, char, residual oils, tar and asphalt. Solid carbon sources, i.e. carbonaceous materials remaining solid at the elevated reaction temperature conditions, such as coal, coke and char are the presently most preferred carbon source materials. The process of the present invention is in particular applicable to the gasification of char which is the solid residue of several coal gasification or pyrolysis processes such as the COED process (developed by the FMC Corporation), the Garrett process, the Synthane process and the Toscoal process.

The solid carbon source materials are used in finely divided form in order to achieve as good and as much contact with the zinc oxide oxygen donor as possible. Preferably, the solid carbon source materials will have a particle size of less than about 0.35 mm. The particle size refers to the longest extension of the individual particles.

The oxygen donor in the main reaction is zinc oxide (ZnO). This commercially available material is used in finely divided form, usually as a powder. The particle size distribution of the zinc oxide preferably is such that all the particles are in the range of 0.2 to 5 microns in diameter. Smaller particles also can be utilized. Larger particles, whereas they can be utilized, have the tendency of slowing the reaction down and, therefore, are less desirable.

The carbon source and the zinc oxide are utilized in a quantity expressed as the equivalent ratio of zinc oxide to carbon in the range of 0.9 to 1.2. Preferably, about 1.0 mol of zinc oxide per gram atom of available carbon in the carbon source is utilized.

The reaction conditions for the main reaction of the carbon with zinc oxide are not critical and preferably are as defined in the following. It is particularly desirable to operate at a temperature above the boiling point of zinc so that the reaction results in a gaseous effluent consisting essentially of carbon monoxide and zinc from which zinc can be readily removed and reoxidized utilizing the heat of oxidation to at least partially supply the heat necessary for maintaining the main reaction. This main reaction is, therefore, preferably carried out at a reaction temperature between 1665° F. and 2800° F. (910°–1540° C.). Even more preferred is a temperature range of 1850° to 2150° F. (1010°–1176° C.) if zinc sulfide is to be retained in the ash; 2200°–2500° F. (1205°–1372° C.) if zinc sulfide is to be vaporized.

The pressure conditions for the main carbon monoxide forming reaction are also not critical. Generally, the reaction between the carbon source and the zinc oxide is carried out at slightly superatmospheric pressure. If desired, however, the reaction can be carried out at higher pressures and high-pressure carbon monoxide can be produced.

The time of the reaction is correlated to the temperature and pressure conditions used. Generally, the time of reaction between the carbon source and the zinc oxide is determined essentially by economic reasons. The reaction generally is faster at higher temperatures so that the reaction time generally is shorter the higher the reaction temperature is. Preferably, therefore, the reaction time will be 5 to 120 minutes for a reaction temperature in the range of 2800° F. to 1670° F. (1540°–910° C.).

In accordance with another embodiment of this invention, a solid carbon source and zinc oxide are reacted in a reaction zone, both reactants being in finely divided form and fluidized. The reaction is carried out at a temperature above the boiling point of zinc and a portion of the zinc and carbon monoxide-comprising gaseous effluent is withdrawn and recycled into the reaction zone such as to fluidize the solid mixture of solid carbon source material and zinc oxide particles. This operation has the advantage that no extraneous materials are being introduced and no additional step for the separation of the product of the process from the fluidizing gas is necessary.

In the process of this invention in both embodiments, a carbon source containing a considerable quantity of sulfur can be utilized. Advantageously, the process produces no volatile sulfur by-products. Zinc sulfide is produced during gasification by reaction of sulfur with zinc oxide. This zinc sulfide can be removed by standard roasting techniques from the ash. The zinc sulfide also can be withdrawn with the gaseous effluent if the reaction temperature of the main reaction between the carbon source and the zinc oxide is above the sublimation temperature of zinc sulfide, which is 1185° C. Zinc sulfide in this case is recovered from the gaseous effluent by subliming it on a cold wall having a temperature well above the boiling point of zinc and well below the sublimation temperature of zinc sulfide.

The invention will be more fully understood from the description of the drawing and the calculated example.

In the drawing a schematic flow diagram of the process of this invention is shown. A carbon source, such as finely divided coal, coke or char, is introduced via line 1 into a reactor 10 from a carbon source 11. Zinc oxide, in finely divided form, is also introduced into the reactor 10 via line 2. During the reaction between the carbon source and the zinc oxide, ash is formed that is withdrawn via line 4 from the bottom of the reactor. The gaseous effluent consisting essentially of carbon monoxide and zinc is withdrawn from the reactor via line 12. This gaseous effluent stream is split into a product stream 3 and recycle stream 13. The recycle stream 13 is reintroduced into the lower portion of the reactor 10 via pump 14. This recycle gas stream 13 serves as a fluidizing gas for the reaction mixture.

The product stream 3, consisting essentially of carbon monoxide and zinc, is exchanged in heat exchanger 15 with liquid zinc whereby the gaseous stream in line 3 is cooled and the zinc is partially condensed. In order to condense all the zinc, the effluent of the reactor is passed from the heat exchanger 15 to a cooler 16 in which most of the zinc that is still in vapor form is condensed. In separator 17 liquid zinc is separated from the gaseous effluent which is withdrawn via line 6 from this separator 17. The liquid zinc is withdrawn via line 18 from the bottom of the separator 17 and passed through pump 19 via line 7 through the heat exchanger 15 in which the zinc is at least partially evaporated and from there via line 22 into contact with an oxidizing agent such as air or stream. The zinc/oxidizer mixture is reacted to form zinc oxide while passing through heat exchange coils 20 located inside of the main reactor 10. Thus the heat developed during the reaction of the zinc with the oxidizer to form zinc oxide is effectively utilized to heat the reaction mixture in reactor 10. The mixture of solid zinc oxide and gas is passed from the heat exchange coils 20 into a cyclone 21 from which a gaseous effluent freed of zinc oxide particles is removed via line 8. From the lower portion of the cyclone 21, the solid, finely divided zinc oxide is withdrawn and reintroduced via line 2 into the reactor and into contact with the carbon source. Makeup zinc oxide is introduced via line 9 to make up for losses of zinc that might occur during the process.

EXAMPLE

This example provides a material balance to show the quantities of reactants and products in the main streams. The quantities given in kilogram per second are such that they correspond to a commercial and economical plantsize operation of the invention. The materials flowing in the various lines, the quantities thereof, as well as the reference numbers of the flow lines are shown in the following table. These reference numbers are the same as those shown in the drawing.

| Line No. in Drawing: | 1 | 2 | 3 | 4 | 5 | 6 | 7 | 8 | 9 |
|---|---|---|---|---|---|---|---|---|---|
| | Material Balance, Kg/sec | | | | | | | | |
| Line Designation: | Char Feed | Zinc Oxide Feed | Product Vapor | Ash & Slag | Air | Product Gas | Recycle Zinc | Vent Gas | Zinc Makeup |
| Stream Composition: | | | | | | | | | |
| Carbon | 10.0 | | | 0.1 | | | | | |
| CO | | | 23.1 | | | 23.1 | | | |
| Zinc | | | 54.0 | | | | 54.0 | | |
| ZnO | | 67.6 | | 0.5 | | | | | 0.5 |
| Nitrogen | | | | | 48.2 | | | 48.2 | |
| Oxygen | | | | | 14.6 | | | 1.3 | |
| Ash | 0.5 | | | 0.5 | | | | | |

Thus, the invention provides means for utilizing the heat produced by the oxidation of zinc at least partially as the heat to be supplied to the endothermic reaction between the carbon source and the zinc oxide to form carbon monoxide. Furthermore, and independently, the invention provides a simple means for efficiently carrying out the reaction between the carbon source and zinc oxide in case a solid carbon source is used. An efficient contact between the carbon source and the zinc oxide particles is achieved by fluidizing the reaction mixture with a portion of the gaseous effluent.

Reasonable variations and modifications which will become apparent to those skilled in the art can be made in this invention without departing from the spirit and scope thereof.

We claim:

1. A process for the production of carbon monoxide which comprises a. introducing a solid carbon source and zinc oxide into a reactor and forming a reaction mixture in said reactor, b. reacting zinc oxide and the carbon source at a temperature of 1665° F. to 2800° F. to form a gas comprising carbon monoxide and zinc, c. withdrawing said gas from said reactor, d. separating zinc from said gas to form a remaining carbon monoxide-comprising gas, and e. introducing in the inlet of indirect heat exchange means arranged in said reactor said zinc with an oxidizing agent to form a zinc oxidation mixture and reacting this zinc oxidation mixture to form zinc oxide in an exothermic reaction, thereby passing this zinc oxidation reaction mixture through indirect heat exchange with said reaction mixture in the reactor.

2. A process in accordance with claim 1 comprising withdrawing said zinc oxidation mixture from the outlet of said indirect heat exchange means, introducing it into a gas-solid-separator, withdrawing zinc oxide from said gas-solid-separator, and introducing this zinc oxide into said reactor.

3. A process in accordance with claim 1 wherein said oxidizing agent is air.

4. A process in accordance with claim 1 wherein said oxidizing agent is steam.

5. A process in accordance with claim 1 wherein said solid carbon source is selected from the group consisting of coal, coke, char.

6. A process in accordance with claim 1 wherein about 0.9 to about 1.2 mols of zinc oxide per gram atom of available carbon in the carbon source are introduced into the reaction mixture.

7. A process in accordance with claim 1 wherein said zinc is separated from said gas stream by condensing the zinc to a liquid and phase separating the remaining carbon monoxide-comprising gas and the liquid zinc.

8. A process in accordance with claim 2 wherein steam is used as said oxidizing agent and wherein a mixture of a gaseous component comprising hydrogen and a solid component comprising zinc oxide is withdrawn from said outlet of said indirect heat exchange means, wherein this mixture is passed to a gas-solid-separator and separated into said gaseous component comprising hydrogen and into said solid component comprising zinc oxide and wherein the remaining carbon monoxide-comprising gas and said gaseous component comprising hydrogen are combined to form a gas composed essentially of carbon monoxide and hydrogen.

9. A process in accordance with claim 1 wherein zinc oxide produced in said exothermic reaction is introduced into said reactor.

10. A process in accordance with claim 1 wherein a solid carbon source is used, wherein a recycle gas stream is removed from said gas, and wherein said recycle gas stream is introduced as a fluidizing gas into the lower portion of said reactor and into contact with said reaction mixture such as to fluidize said reaction mixture.

11. A process in accordance with claim 10 wherein said recycle gas stream constitutes about 2 to about 50 wt. % of the entire gas withdrawn from the reactor.

* * * * *